US007311612B2

(12) United States Patent
DeLucia

(10) Patent No.: US 7,311,612 B2
(45) Date of Patent: Dec. 25, 2007

(54) GOLF CLUB HEAD WITH BI-POLAR MAGNETIC IMPACT DETECTORS

(76) Inventor: Victor E. DeLucia, 5121 W. Park Dr. Apt 110, N. Hollywood, CA (US) 91601

( * ) Notice: Subject to any disclaimer, the term of this patent is extended or adjusted under 35 U.S.C. 154(b) by 196 days.

(21) Appl. No.: 11/350,002

(22) Filed: Feb. 9, 2006

(65) Prior Publication Data

US 2007/0184912 A1 Aug. 9, 2007

(51) Int. Cl.
*A63B 53/06* (2006.01)
*A63B 53/16* (2006.01)
*A63B 69/36* (2006.01)

(52) U.S. Cl. ..... 473/237; 473/231; 473/235

(58) Field of Classification Search ..... 473/237; 446/129

See application file for complete search history.

(56) References Cited

U.S. PATENT DOCUMENTS 2,592,013 A 4/1952 Curley
2,660,436 A 11/1953 Grossman
3,438,634 A 4/1969 Roy
3,730,529 A 5/1973 Donofrio
3,964,190 A * 6/1976 Leo ..... 40/412
3,979,125 A 9/1976 Lancellotti
4,135,720 A 1/1979 Lancellotti
4,898,389 A 2/1990 Plutt
5,366,222 A 11/1994 Lee
5,482,282 A * 1/1996 Willis ..... 473/342
6,015,353 A 1/2000 Romano

* cited by examiner

*Primary Examiner*—Joe H. Cheng
*Assistant Examiner*—Michael D Dennis
(74) *Attorney, Agent, or Firm*—Buhler & Associates; Kirk A. Buhler

(57) ABSTRACT

A golf club head with multiple cells of magnetically held pins is disclosed. The cells are placed on the sweet spot on the head of the golf club. The pins within the cells are set to extend beyond the face of the golf club and maintained in position with a bi-polar magnetic force. When the pins make contact with a golf ball the magnetic field holding the pin(s) in position is broken and the pin is pushed into a rear position where it is held in a retracted magnetic position. The impact location of the ball on the head of the golf club can then be determined by visually looking at the location of the displaced pins. The pins can then be manually pushed to the initial position and the club is ready to detect the impact location with subsequent golf balls.

19 Claims, 3 Drawing Sheets

GOLF CLUB HEAD WITH BI-POLAR MAGNETIC IMPACT DETECTORS

FIELD OF THE INVENTION

This invention relates to improvements in identifying the impact location of a golf ball on the head of a golf club. More particularly, the present invention uses multiple cells of magnetically held pins located within the sweet spot on a golf club head that are displaced when they make contact with a golf ball to identify the location of impact of the ball on the head of the golf club iron or putter.

BACKGROUND OF THE INVENTION

One of the most important factors in golfing is hitting the ball correctly with the golf club to ensure the ball will travel where desired and not hook or slice to send the ball in an undesirable location. To get the ball to travel where desired the head of the golf club must impact the ball in the center or "sweet spot" on the face of the club. It is often difficult to determine if the ball is struck in the optimal location on the head of a club, and the trajectory of the ball provides some indication of where the club made contact with the ball but it does not provide a positive identification of the contact point on the head of the club. Several patents have been issued that try to address providing feedback to the user on where the ball made contact with the head of a golf club.

U.S. Pat. No. 2,660,436 issued to E. F. Grossman on Nov. 24, 1953 discloses an indicating disk for a golf club head that is placed on the face of a golf club. When the golf club makes contact with the golf ball, a mark is placed on a sweet spot target that is adhered to the face of the golf club. While this patent provides some feedback on the impact location, it requires an expendable component that is saved or discarded, it does not utilize pins that are magnetically held in a biased position to identify the location of impact U.S. Pat. No. 3,438,634 issued to E. Roy on Apr. 15, 1969 and U.S. Pat. No. 4,898,389 issued to Plutt on Feb. 6, 1990 disclose an electronic device that is either attached to the head of a golf club or integrated into the head of a golf club that registers and display the point of impact with a golf ball. While these patents disclose detection and display system for indication where the ball and head of the golf club made contact they require a power supply for operation and they do not utilize pins that are magnetically held in a biased position to identify the location of the impact. '389 further only identifies horizontal and no vertical information regarding the impact location.

U.S. Pat. No. 3,730,529 issued to Donofrio on May 1, 1973 discloses a stroke indicating golf club. The golf head includes a plurality of pins that slide within the head of the golf club. While this patent provides for indicating pins the pins only show impact information horizontally across the head of the club and there is not a magnetic field that holds the pins biased in one of two locations on the head of the club. The lack of magnetic field(s) allows the pins to freely move based upon an impact. The frictional system that maintains the pins in position is further prone to wear from repeated use of the golf club.

U.S. Pat. Nos. 3,979,125 and 4,135,720 issued Sep. 7, 1976 and Jan. 23, 1979 respectively both issued to William E. Lancellotti disclose a golf putter practice device. The device has a metal ball that is held in position by a magnet and when the club makes contact with a golf ball the metal ball is dislodged from the magnet and rolls into a plurality of holes that indicate where the ball made contact with the club. While these patents disclose a detection and display system for indication where the ball and head of the golf club made contact they do not disclose a plurality of pins to identify where the ball made contact with the head of the club, and because there is no retention mechanism such as a magnet in the resting position of the metal ball the information regarding the contact with the ball and the club can be lost when the club is swung.

What is needed is a simple to use golf club to golf ball detection and display means that incorporates magnetically biased pins that allow the identifying pins to exist in a forward or back biased position showing where the club struck the ball. The proposed application provides this function by providing magnetically biased pins that show the impact location of the ball and the head of the golf club.

BRIEF SUMMARY OF THE INVENTION

It is an object of the golf club with ball impact location indicator(s) to provide a detection and display device consisting of a plurality of cells made from bi-polar magnetic impact detector pins strategically placed in the sweet spot in the head of a golf club to identify where the face of the golf club made contact with a golf ball. This information helps to significantly improve the golfing ability of a golfer to make more accurate and longer drives, chips and putts.

It is an object of the golf club with ball impact location indicator to make the impact indicator using pins that extend slightly past the face of a golf club. The pins create the initial impact location of the ball on the golf club. Upon impact the pins are pushed from their extended position. The location(s) of any displaced pins are used to determine where the contact occurred.

It is another object of the golf club with ball impact location indicator to utilize a magnet with two opposing ferrous plates. A pin is attached to the magnet and the pin/magnet assembly is placed between the two opposing ferrous plates. The magnet is attracted and held to one of the two ferrous plates. When sufficient force is applied to an end of the pin the magnetic attraction is overcome and the pin/magnet assembly is dislodged from one ferrous plate and is attracted and held by the opposing ferrous plate.

It is still another object of the golf club with ball impact location indicator to allow the pins to be manually moved from an indicating position to a set position using manual force. The simple method utilized to quickly and easily reset the indicators is critical to providing a fast simple reset method that can be utilized when a golfer is at a driving range.

Various objects, features, aspects, and advantages of the present invention will become more apparent from the following Detailed Description of preferred embodiments of the invention, along with the accompanying drawings in which like numerals represent like components.

DETAILED DESCRIPTION

Figure 1:
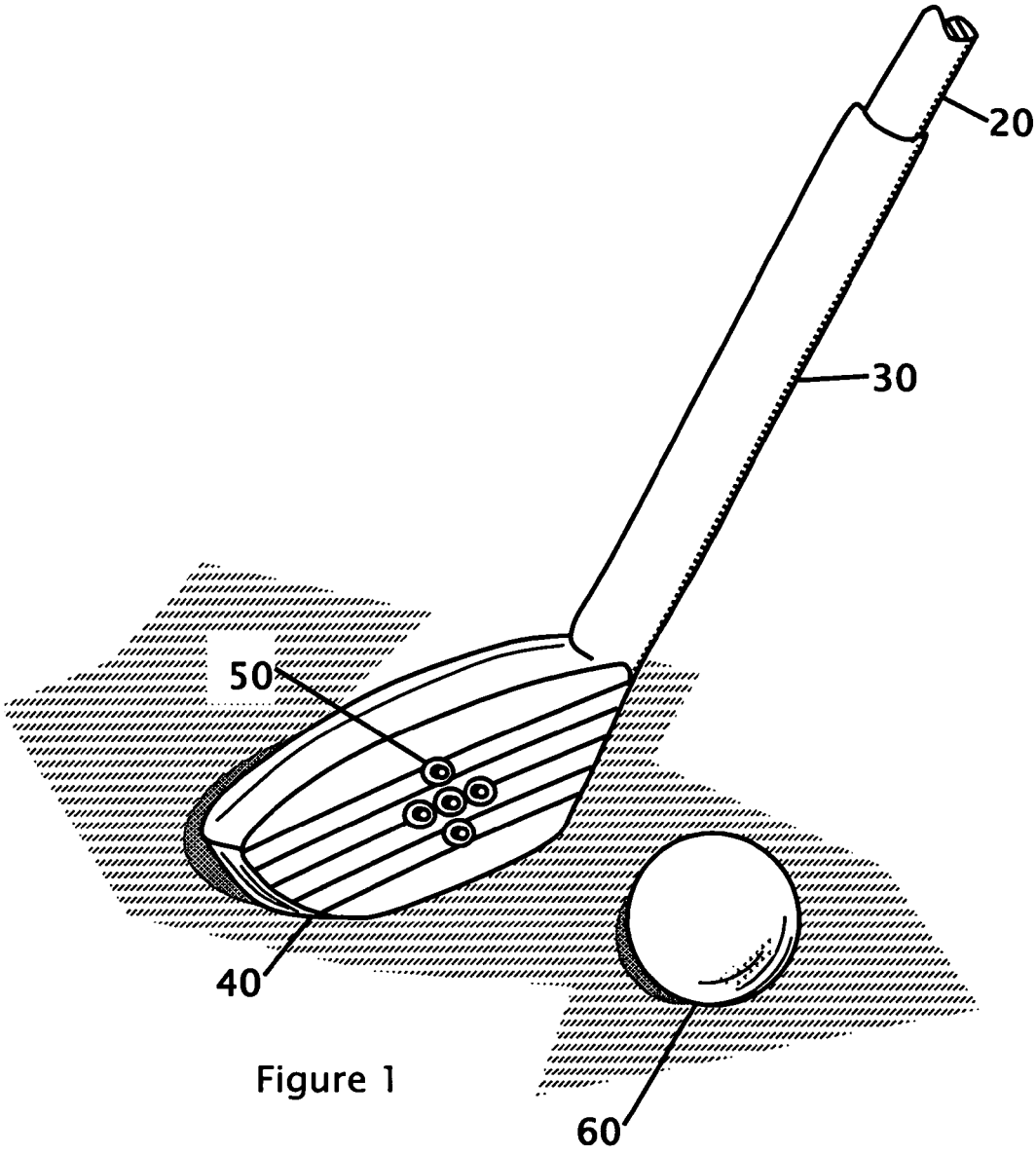
FIG. 1 shows an isometric view of an iron golf club head with the magnetic ball impact detecting pins extended.

FIG. 1 shows an isometric view of an iron golf club head with the magnetic ball impact detecting pins extended. In the preferred embodiment the magnetic ball detection pins are set in the head of a golf club iron 40. with the exception to the inclusion of the magnetic ball impact detecting pins, the golf club iron is essentially the same where it includes a golf club shaft 20 mounted to an extension 30 from the iron body. The bi-polar magnetic ball impact detecting pins 50 contained inside five cells are shown in the front extension position where they are ready to detect impact with a golf ball 60. Five pins are shown in this figure arranged in the sweet spot of the iron. The arrangement of the pins is in a diameter of about the size of a nickel. This orientation shows five pins, but as few as one pin can be used to as many as can be reasonably placed on the iron are contemplated. In the case of a beginning golfer the iron may have more magnetic ball impact detecting pins to aid the beginning golfer to strike the ball in the sweet spot of the iron while a more experienced golfer may require fewer pins. The configuration shown is most ideal for an experienced golfer because an ideal shot would only be detected by the center pin being pushed back. Variability from the "ideal" strike is detected and shown by other pins or a combination of the center pin along with other pins. The detection and identification of impact between the iron and the golf club is shown in FIG. 2.

Figure 2:
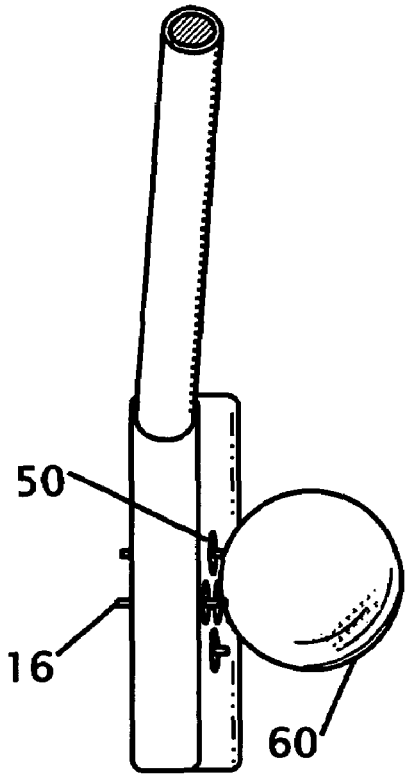
FIG. 2 shows a top view of a driver golf club head at the point of impact with a golf ball.

FIG. 2 shows a top view of a driver golf club head at the point of impact with a golf ball. The golf ball 60 in this figure is shown making contact with the iron in a position that is slightly off of the sweet spot of the golf club. Two pins 16 are shown protruding out the back of the iron. In the basic operation of the magnetic ball impact detecting pins 50, a magnet holds the pins in a forward or rearward position within each cell. When sufficient force is applied to an extended pin the magnetic force holding the pin in this position is overcome and the pin is moved to the opposing side where bi-polar magnetic force attracts and holds the pin on the opposite side. The construction of the cell with the magnetic ball impact detecting pins is shown and described in more detail in FIGS. 3-5.

Figure 3:
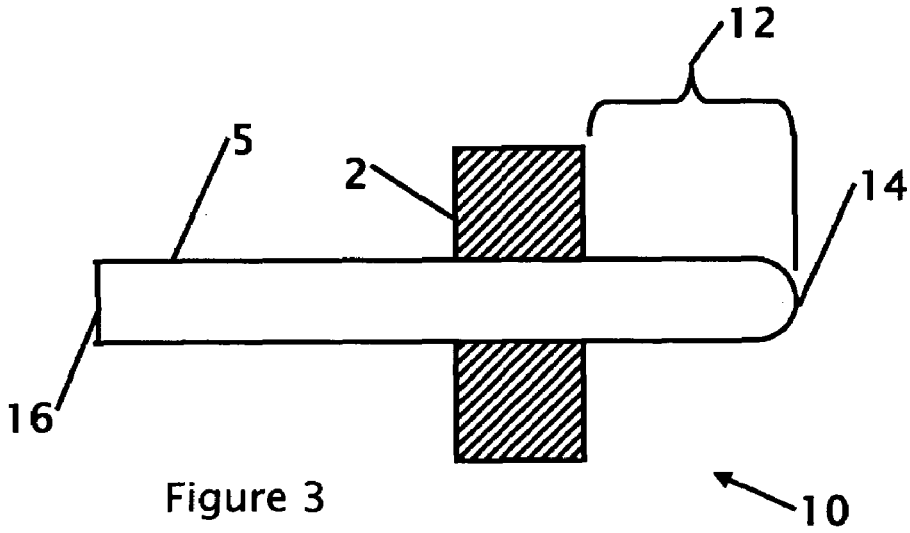
FIG. 3 shows a detailed view of a pin assembly for the magnetic ball impact detection unit.
Figure 4:
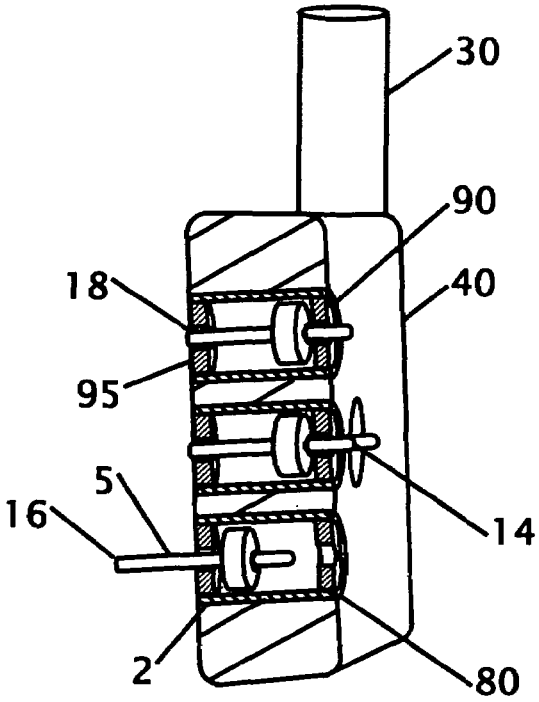
FIG. 4 shows a cross sectional view of one embodiment of a putter with the magnetic ball impact detection cells installed.
Figure 5:
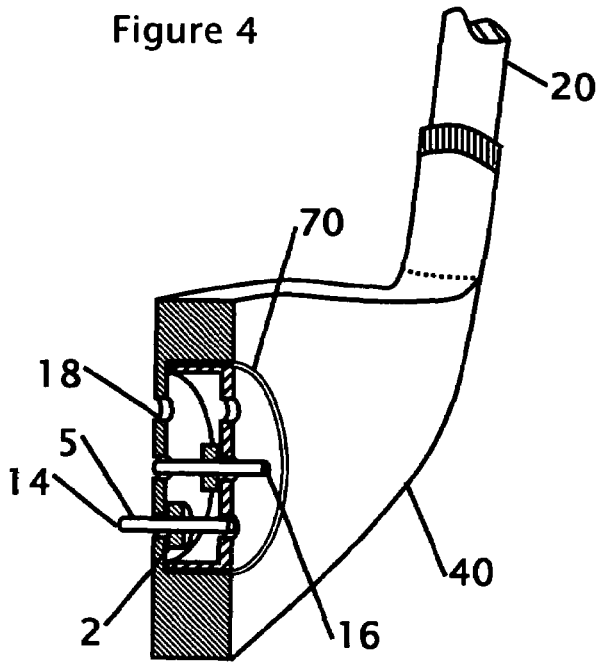
FIG. 5 shows a cross sectional view of another embodiment of a left handed iron with the magnetic ball impact detection units installed.

FIG. 3 shows a detailed view of a pin assembly for the magnetic ball impact detection unit. This unit 10 is the only moving component in the golf club to golf ball detection mechanism. The pin assembly consists of a pin 5 made from a non-magnetic material. In the preferred embodiment the non-magnetic pin is made from a stainless steel pin, but pins made from other non-magnetic materials are contemplated. The stainless pin preferably has a hardness of Rockwell 50-60 to extend the life of the pin. Another desirable property of using a stainless steel pin is its ability to not rust. The diameter of the pin is preferably about 1 mm or 0.040 inches with a length of about 0.330 long. One end of the pin 14 is rounded. The pin is rounded to minimize damage to the golf ball. The opposite end 16 of the pin is flattened. A magnet 2, preferably of the rare earth type is bonded with an epoxy or Cyanoacrylate adhesive to the shaft 5 at a location 12 approximately 0.100 inches from the tip of the rounded end 14 of the shaft. The magnet has a center hole to accept the shaft 5 and is preferably 0.060 thick and 0.15 inches in diameter but other sizes and shapes are contemplated and have been used in prototypes. One or more cells is/are placed in the head of the iron to show the detection of an impact. FIGS. 4 and 5 show embodiments with the cells installed in the head of golf club irons.

FIG. 4 shows a cross sectional view of one embodiment of a putter with the magnetic ball impact detection cells installed. The shaft portion of the putter is shown as item 30 joining into the face 40 of the putter. Three shaft assemblies are shown and described in FIG. 3 are shown in this figure. The shaft assemblies are shown inside of three cylindrical tubes 80. The tubes are constructed from non-magnetic stainless steel tubing. The tubing is approximately 0.200 inches in diameter, having a wall thickness of about 0.005 inches and an overall length of 0.220 long. The shaft 5 and magnet 2 assemblies is shown located within the tube 80 and capped on both ends with soft iron poles 90 and 95. The assembly comprising the pin assembly within the tube 80, capped with the soft iron poles is a cell assembly that is bonded into a golf cub iron. The soft iron poles have a hole sufficiently sized to allow the shaft 5 to pass through. In the preferred embodiment the soft iron poles have an outside diameter of 0.1734 to 0.1754 and are bonded to the ends of the tube 80 using an epoxy or Cyanoacrylate adhesive. The hole is preferably 0.053 to 0.057 inches in diameter to allow the shaft 5 to pass and slide through the center hole 18. The shaft is shown with the rounded side 14 extending where a ball can make contact with the face of the putter and the flat end 16 on the side opposing the face of the putter. The iron poles have a thickness of 0.048 to 0.052. The soft iron pole material is used because of the high ferrous content of the material allowing it to easily attract the magnet 2. The magnet 2 is attracted to both the front 90 and rear 95 iron poles and because of the magnetic attraction it will stay at either position until sufficient force is applied to break the bi-polar magnetic bond. The magnetic attraction is the greatest when the magnet is in contact with a soft iron pole. The rounded end of the pin extends out the front face of the golf club iron about 0.050 inches. Contact with a golf ball pushes the pin inward and away from the front soft iron pole thus breaking the magnetic hold. As the pin assembly is being pushed away from the front soft magnetic pole, it will become attracted to the rear magnetic pole, where it will be brought into contact with the rear soft iron pole. The golf ball does not push the pin assembly all the way into the back of the cell. The pin assembly is magnetically pulled the remaining 0.020 to 0.030 to make contact with the rear soft iron pole. The end of the travel of the pin is not pushed by the golf ball to prevent damage to the cell from the golf ball smashing the pin assembly into the rear soft iron pole. The person using the golf club can then view where the club and ball made contact by viewing the position of the pins. Once the detected position is determine the back, or flat side, of the pin can be pushed to extend the pins out the front of the face of the putter or iron and the putter or iron is ready for use on another golf ball.

FIG. 5 shows a cross sectional view of another embodiment of a left handed iron with the magnetic ball impact detection units installed. The shaft of the iron 20 is shown extending into the body of the iron 40 where the detection portion is located. In this embodiment the holes 18 extend through the face of the club 40. An iron cap 70 encloses all the golf ball detection components. The magnets 2 are located on shafts 5. The round tip 14 of the pin 5 extends out the front face of the iron, and the flat end 16 of the pin 5 extends out the back of the iron through cap 70. The operation of detection of impact with a golf ball and identification of where the impact occurred is basically the same as previously described where contact with a golf ball pushes on the rounded portion of one or more pins to brake the magnetic bond from the front surface and further pushing on the pin until it is attracted and held by the rear ferrous surface. The figures and description show and describe the preferred embodiments, but other sizes, shapes, configurations and materials are contemplated that provide the basic function of the product using bi-polar magnetic attraction to identify one of two discrete conditions of impact. The use of magnets and ferrous materials provide an ideal solution to the detection and display function because only physical dislodging of the magnetic attraction will move the pins.

Thus, specific embodiments of a golf ball to golf club point of impact detection have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A golf ball impact location indicating apparatus for identifying the impact location of a golf ball on the face of a golf club head, comprising:

a head of a golf club;

at least one hollow chamber located within the head of the golf club; and a magetic impact detecting apparatus, said apparatus cormprises at least one pin assembly housing in the hollow chamber and located on the face of the head of the golf club and extended beyond the face and the back portions of the golf club head; and wherein the at least one pin assembly is magnetically held in a forward biased location with a first ferrous member and upon forced contact with a golf ball the pin is dislodged from the forward biased location and is held in a rear biased location by a second ferrous member.

2. A golf ball impact location indicating apparatus from claim 1 in which the pin assembly consists of a pin concentrically suspended in a circular ring magnet.

3. A golf ball impact location indicating apparatus from claim 2 in which the pin is made from a non-magnetic material.

4. A golf ball impact location indicating apparatus from claim 1 in which the first ferrous member is essentially a soft iron washer where one end of the pin can pass through the center of the washer.

5. A golf ball impact location indicating apparatus from claim 1 in which the second ferrous member is essentially a soft iron washer where one end of the pin can pass through the center of the washer.

6. A golf ball impact location indicating apparatus from claim 1 wherein said hollow chamber includes an elongated housing that houses the pin assembly between the first and second ferrous members.

7. A golf ball impact location indicating apparatus from claim 6 in which the elongated housing is made from a non-magnetic material.

8. A golf ball impact location indicating apparatus from claim 1 in which the face of the golf club includes a plethora of pin assemblies placed within the head of the golf club.

9. A golf ball impact location indicating apparatus from claim 1 in which five pin assemblies are arranged in the sweet spot of the golf club head.

10. A golf ball impact location indicating apparatus from claim 1 in which the movement of the pin assembly provides information regarding the contact location of the golf club with the golf ball.

11. A magnetic impact detecting apparatus for identifying the impact location of a golf ball on the face of a golf club head, comprising:

a head of a golf club;

a hollow chamber; wherein said hollow chamber located within the head of a golf club;

a first ferrous member located essentially at one end of the hollow chamber;

a pin supported on a magnet positioned concentric within the hollow chamber where the pin extends beyond the face and the back portions of the golf club head; and a second ferrous member located essentially at the opposing end of the hollow chamber; wherein the pin supported on the magnet can be translated within the hollow chamber to attract the magnet to the first or second ferrous member to identify contact of the pin with a golf ball.

12. A magnetic impact detecting apparatus from claim 11 in which the pin is made from a non-magnetic material.

13. A magnetic impact detecting apparatus from claim 11 in which the first ferrous member is essentially a soft iron washer.

14. A magnetic impact detecting apparatus from claim 11 in which the second ferrous member is essentially a soft iron washer.

15. A magnetic impact detecting apparatus from claim 11 in which the hollow chamber is made from a non-magnetic material.

16. A magnetic impact detecting apparatus from claim 11 in which the face of the golf club includes a plethora of magnetic impact detecting apparatus located within the head of a golf club.

17. A magnetic impact detecting apparatus from claim 11 in which five pin assemblies are arranged in the sweet spot of the golf club head.

18. A magnetic impact detecting apparatus from claim 11 in which the hollow chamber is a cylindrical tube.

19. A magnetic impact detecting apparatus from claim 11 in which the pin extends beyond the end of the first or second ferrous member between 0.000 and 0.250 inches.

* * * * *